US006802264B2

(12) United States Patent
Kasak et al.

(10) Patent No.: US 6,802,264 B2
(45) Date of Patent: Oct. 12, 2004

(54) SLIDE-AWAY WORK TOP FOR COMPUTER STATIONS

(76) Inventors: Charles J. Kasak, 89 Algonquin Rd., Yonkers, NY (US) 10710; Robert Kasak, 465 Taylor Ave., South Hackensack, NJ (US) 07606

( * ) Notice: Subject to any disclaimer, the term of this patent is extended or adjusted under 35 U.S.C. 154(b) by 136 days.

(21) Appl. No.: 10/341,227

(22) Filed: Jan. 13, 2003

(65) Prior Publication Data

US 2004/0134389 A1 Jul. 15, 2004

(51) Int. Cl.[7] ..... A47B 37/00
(52) U.S. Cl. ..... 108/50.01; 108/143
(58) Field of Search ..... 108/50.01, 50.02, 108/143, 90, 102; 312/194, 195, 196, 223.3, 223.1; 248/918

(56) References Cited

U.S. PATENT DOCUMENTS

| | | | | | |
|---|---|---|---|---|---|
| 4,515,086 | A | * | 5/1985 | Kwiecinski et al. | 108/143 |
| 4,717,112 | A | * | 1/1988 | Pirkle | 108/143 |
| 4,732,089 | A | * | 3/1988 | Mueller | 108/102 |
| 5,037,163 | A | * | 8/1991 | Hatcher | 108/143 |
| 5,287,815 | A | * | 2/1994 | Gross | 108/50.01 |
| 5,896,817 | A | * | 4/1999 | Hancock | 108/50.01 |
| 6,269,753 | B1 | * | 8/2001 | Roddan | 108/50.01 |
| 6,279,489 | B1 | * | 8/2001 | Daniel | 108/50.01 |
| 6,474,760 | B2 | * | 11/2002 | Rauls | 108/50.01 |

FOREIGN PATENT DOCUMENTS

| | | | | | |
|---|---|---|---|---|---|
| GB | 2196575 | A | * | 5/1988 | B25H/1/00 |
| JP | 05184426 | A | * | 7/1993 | A47B/37/00 |

* cited by examiner

*Primary Examiner*—Jose V. Chen
(74) *Attorney, Agent, or Firm*—Donald R. Heiner

(57) ABSTRACT

A work top to be used in conjunction with a computer work station which has a pull-out keyboard shelf that may be pulled out to varying distances. The disclosure provides such a work top which can be temporarily moved aside by simply being pushed or by pulling it to slide it back onto a keyboard shelf of a piece of computer furniture that has a pull-out keyboard shelf that may be pulled out to varying distances.

The device is simplistic in that the final adjustments need be made only once; that is, when the device is first placed over a cart or desk top and the movable parts under the device are placed in the desired position. The device can be installed or removed by simply placing it onto the pulled-out keyboard shelf and by lifting it off the keyboard shelf.

The structure consists of a basic hardboard top, probably rectangular, and wherein each of its four corners are slightly rounded. Near one end or edge of this hardboard top a strip of material is attached by any well known structure and which acts to prevent a work piece such as a paper or book from falling off the hardboard top when it is in its slanted work position. Affixed to the underside of this hardboard top is a rail which slides across a guide which is attached to the top surface of the keyboard. Further, a slotted slide member is disposed on the under surface of the hardboard top by any well known fastening device and the slotted slide member has a second, smaller, rectangular, member affixed to it. This smaller member is used as a stop when the slide away work top is pushed aside and is used to adjust the work top to varying thicknesses of a cart top or desk top.

9 Claims, 6 Drawing Sheets

SLIDE-AWAY WORK TOP FOR COMPUTER STATIONS

BACKGROUND OF THE INVENTION

1. Field of Invention

The thrust of applicant's invention is to provide a work top which can be temporarily moved aside by simply being pushed or pulling it to slide it back onto a keyboard shelf of a piece of computer furniture that has a pull-out keyboard shelf. The device is adjustable to fit varying thicknesses of cart or desk tops and is also adjustable to fit over shelves, such as keyboard shelves, that may be pulled out at varying distances.

The device is simplistic in that the final adjustments need to be made only once; that is, when the device is first placed over the cart or desk top and the movable parts under the device are placed at its proper setting. The only required tool is a screwdriver.

Further, after the adjustments have been made, the device may be installed or be removed by simply placing it onto the pull-out keyboard shelf and by lifting it off the keyboard shelf.

The device, further, may be used by both left-handed and right-handed users. Still further, two of the devices may be used simultaneously. One may be placed at the left for a book and the other at the right to write.

2. Description of the Prior Art

A search of the prior art has uncovered the following patents: Cope, et al., U.S. Pat. No. 4,428,631; Foster, U.S. Pat. No. 4,657,214; Pirkle, U.S. Pat. No. 4,717,112; Mueller, U.S. Pat. No. 4,732,089; Hancock, U.S. Pat. No. 5,896,817; and two patents to Burch Jr., U.S. Pat. Nos. 6,042,075 and 6,109,585.

No single reference cited above and found during our search discloses all the features of applicant's invention, although some of these prior art references do disclose some, but not all, of the elements of this invention.

The Cope, et al patent, U.S. Pat. No. 4,428,631, is of some interest for its disclosure in FIG. 1 of Items 4, 7, 8, 9, and 13. Also of interest is the language contained in Column 3, Line 63 through Column 4, Line 15.

The Foster patent, U.S. Pat. No. 4,657,214 is of interest for the language contained in Column 1, Lines 53–68. However, the mechanism for operation of this movable copy support surface 30 is described in Column 4, Line 24–38 and it seems to be substantially different from applicant's invention.

The Pirkoe patent, U.S. Pat. No. 4,717,112, relating to a computer work station, discloses elements 20, 26 or 28, but which are not movable from side to side.

The Mueller patent, U.S. Pat. No. 4,732,089, is a guided tabletop platform which teaches a roller-equipped platform movably supported upon a tabletop along with stop elements at opposite ends of a track to limit the extent of side ways movement of the platform upon the tabletop. This is clearly and obviously different from applicant's invention.

The patent to Hancock, U.S. Pat. No. 5,896,817, is of minimal interest for teaching of a computer desk top with tilted work surface. In this patent, there are a plurality of transfers rails which are removably positioned at selected positions across the upper surface of a work surface panel. Further, there are rails 40 serve to hold papers, books, files, accessories, et cetera in positions selected by placement of the rails on the surface of panel 16 which prevents the items from sliding down the panel.

It is not seen that any of the above cited references either taken singularly or in combination, discloses the concept of applicant's invention as will be claimed below.

SUMMARY OF INVENTION

According to the present invention, there is provided a slide away work top for use with a piece of computer furniture that has a pull-out keyboard shelf. Normally, when a keyboard shelf is pulled out toward the user the computer operator is disadvantageously positioned at some distance from the computer furniture top itself. Thus, in this position, there is no readily convenient place to write or to place a book, etc. Further, especially when using this device for holding a book, the book can readily be set aside any number of times while the computer is being operated.

With the device taught by this invention the slide-away work top provides a work surface for the computer operator which can be easily and temporarily pushed to one side and then, when necessary, pulling it to slide it back on to the keyboard shelf that the computer operator is using.

In addition, this slide-away work top is very easily adjustable to fit cart tops and desk tops which are of varying thicknesses. Still further, and quite advantageously, such slide-away work top can also be adjusted to fit over such keyboard shelves that may be pulled out at varying distances.

A very important feature is that once the invention is placed onto the keyboard shelf and is adjusted to meet the user's conditions, the adjustments, made with a common screwdriver, need be made only once. Thus, after such final adjustments are made, the slide-away work top may be installed by quite easily placing it onto the keyboard shelf and can then be removed by lifting it off the shelf.

It should be obvious that this work top may be used by either a left or right handed person. In fact, two such slide-away work tops may be used simultaneously. As an example, one work top maybe placed at the left for a book and the other may be placed at the right to write.

In essence, the invention comprises essentially eight (8) basic components. Further, while not forming a part of the invention, a plastic piece may be provided to prevent wear of the cart top or desk top edge. It is merely placed on the front edge of such top and will not be fastened to the computer furniture itself. The underside of such plastic piece comprises a non-slip material.

The basic or main components of the invention are essentially eight (8) elements. There is provided the basic hardboard top which may have each of four (4) corners slightly rounded, although that is not a requirement. Fastened to this hardboard top near one edge, which will later be described as its lower edge, is a stop member extending length wise across the hardboard top which serves to prevent a paper or book from sliding off the hardboard top when it is in its slanted or angled position. A rail member is disposed on the underside of the hardboard top, near the edge having the stop member, which rail slidably engages a guide member which is mounted to the pull-out keyboard shelf itself. It should be noted that this member or rail is angled such that it will compensate for any disparity which would be the angle between the hardboard top and the existing keyboard shelf. A wrist rest or ergonomic wrist support pad would normally be disposed at the edge of the pull-out shelf slightly forward of the guide in which the rail slides.

A guide plate is affixed to the underside of the hardboard top for reasons to be more fully described below, and it has two or any other convenient number of counter sunk screws so that these screws are flush, thereby facilitating attachment of this guide plate to the underside of the hardboard top. Such screws further have one adjustment knob which thread onto the screws.

It will be seen in the drawings and in the description below that this guide plate comprises three sections. Slidably engaging the desired section of the guide plate is an adjustment plate having an angled vertical member which will compensate for the difference in angle between the hardboard top of this invention and the existing desk top. Such adjustment plate helps keep another adjustment plate parallel with the existing desk top. This other adjustment plate butts up against the underside of the desk top and will therefore sandwich such desk top between this plate and the underside of the hardboard top which forms the subject matter of this invention. This plate may be adjusted up and down or, vertically. The first mentioned adjustment plate can move fore and aft and it further comprises a slot which will slidably engage the aforementioned counter sunk screw on the guide plate itself. This slidable adjustment plate will butt up against the front edge of the desk or cart top when it is slid into the guide plate. This adjustment plate provides for adjustment of the invention to the varying distances that the keyboard shelf may be pulled out.

Fastened to the keyboard shelf itself, forward of a standard wrist rest, is a guide in which the aforementioned rail slides such that the hardboard top which forms the subject matter of this invention, may be easily pushed or pulled.

It is therefore an object of the present invention to provide a work top for any piece of computer furniture having a keyboard shelf which is pulled out.

It is another object of the invention to provide such a work top that can slide away from or toward a computer operator.

It is yet a further object of the invention to provide such a work top which may be installed on a pulled out keyboard shelf and furniture top.

It is yet a further object of the invention to provide such a work top that can be easily and temporarily removed from the computer furniture.

It is yet a further object of the invention to provide such a work top wherein a lip is provided to prevent a book, paper, or any other document, from sliding off this work top.

It is still further an object of the invention to provide such a work top wherein such work top may be adjusted to allow for the distance that a computer keyboard is pulled from any computer furniture and also which may be adjusted to the thickness of such furniture top.

It is still a further object of the invention to provide such a work top wherein the foregoing adjustments need to be made only once when the device is first installed over the computer operator's keyboard shelf.

These and further objects, features and advantages of the invention shall become apparent from the following detailed description of a preferred embodiment thereof when taken in conjunction with the drawings, wherein, like reference characters refer to corresponding parts in the several views.

DETAILED DESCRIPTION OF THE PREFERRED EMBODIMENT

A slide-away work top to be used in conjunction with any piece of computer furniture that employs a keyboard shelf that may be pulled out will now be described with reference to the drawings.

Figure 1:
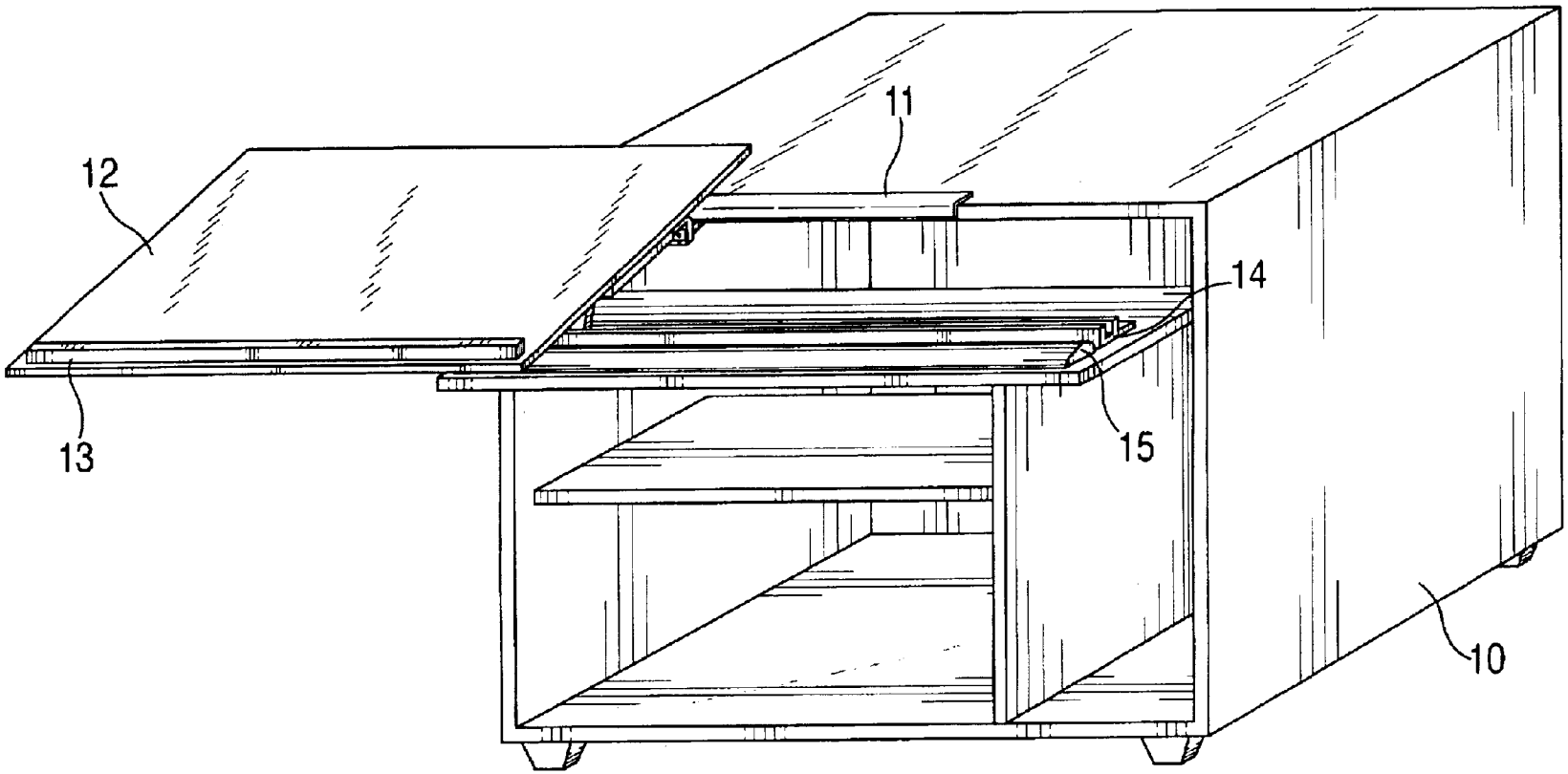
FIG. 1 is a perspective view of the device showing the work top moved to the left of a computer keyboard.
Figure 2:
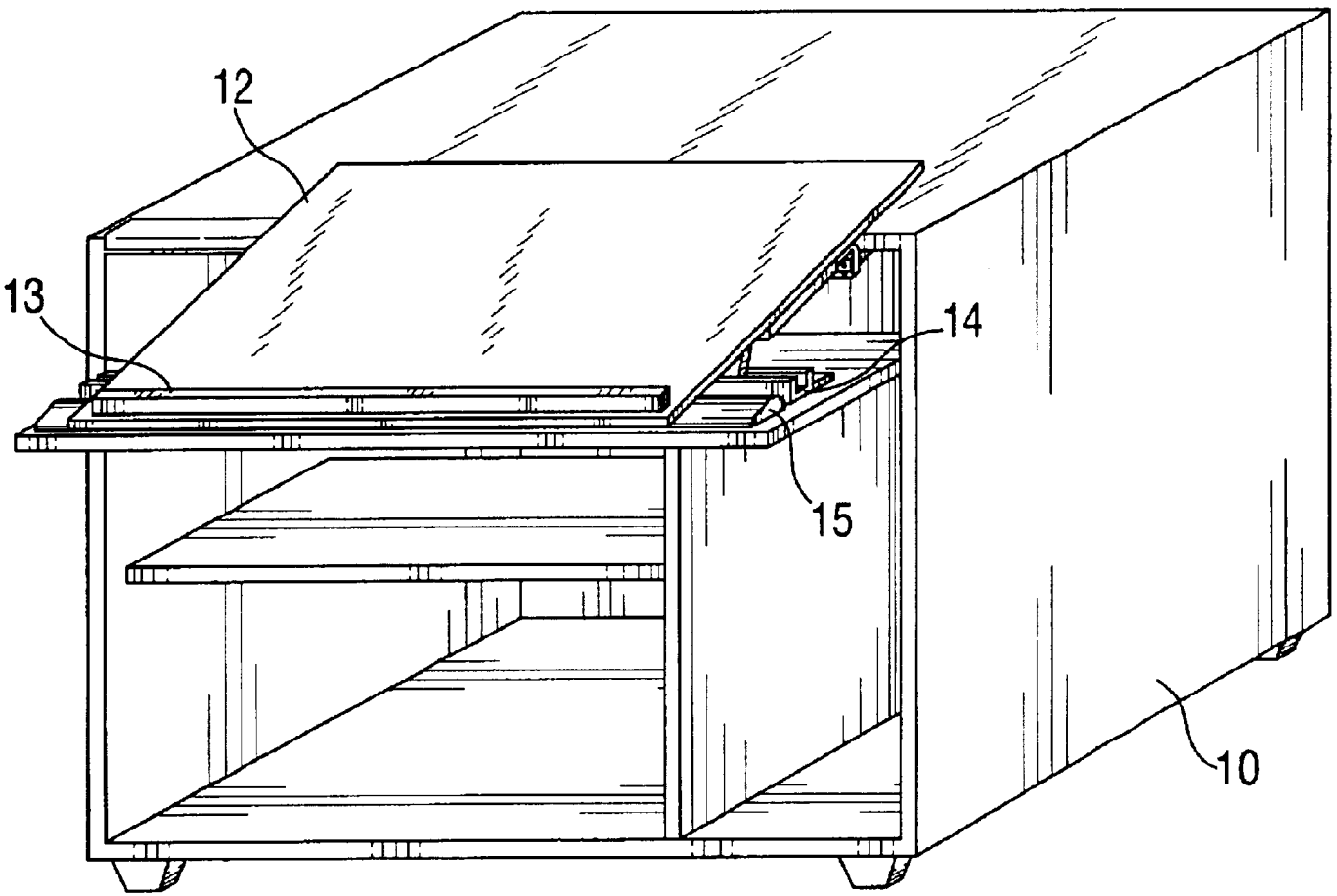
FIG. 2 of the invention is a perspective view with the work top moved back to the right and centered on the computer furniture.

FIGS. 1 and 2 depict a piece of computer furniture, such as a computer cart, shown at number 10 having placed at its upper front edge, an edge guard such as shown at 11. The slidable hardboard top 12 which forms the subject matter of this invention is shown generally as Item 12 in both FIGS. 1 and 2. Attached to such hardboard top is a lip 13 to prevent a book or document or any other material from sliding off the slanted hardboard top 12 which is obviously sloped downwardly and at an angle from the computer cart top 10.

A guide 14 is fastened to a slide-out keyboard shelf for slidably receiving a rail 15. engages the desired Section 18 of guide plate 16 and is seen to have an angled vertical member 22 to compensate for the difference in the angle between the hardboard top and the existing keyboard shelf and which will also keep another adjustment plate 24, yet to be described, parallel with the existing desk top. Such angled vertical member 22 is believed best seen in FIG. 6.

This adjustment plate 21 may move fore and aft due to slot 23 formed therein for the passing through of the countersunk screws 19 that extend from guide plate 16. This is probably best seen in FIG. 6. This slot 23 in adjustment plate 21 is also clearly seen in FIG. 3.

Figure 3:
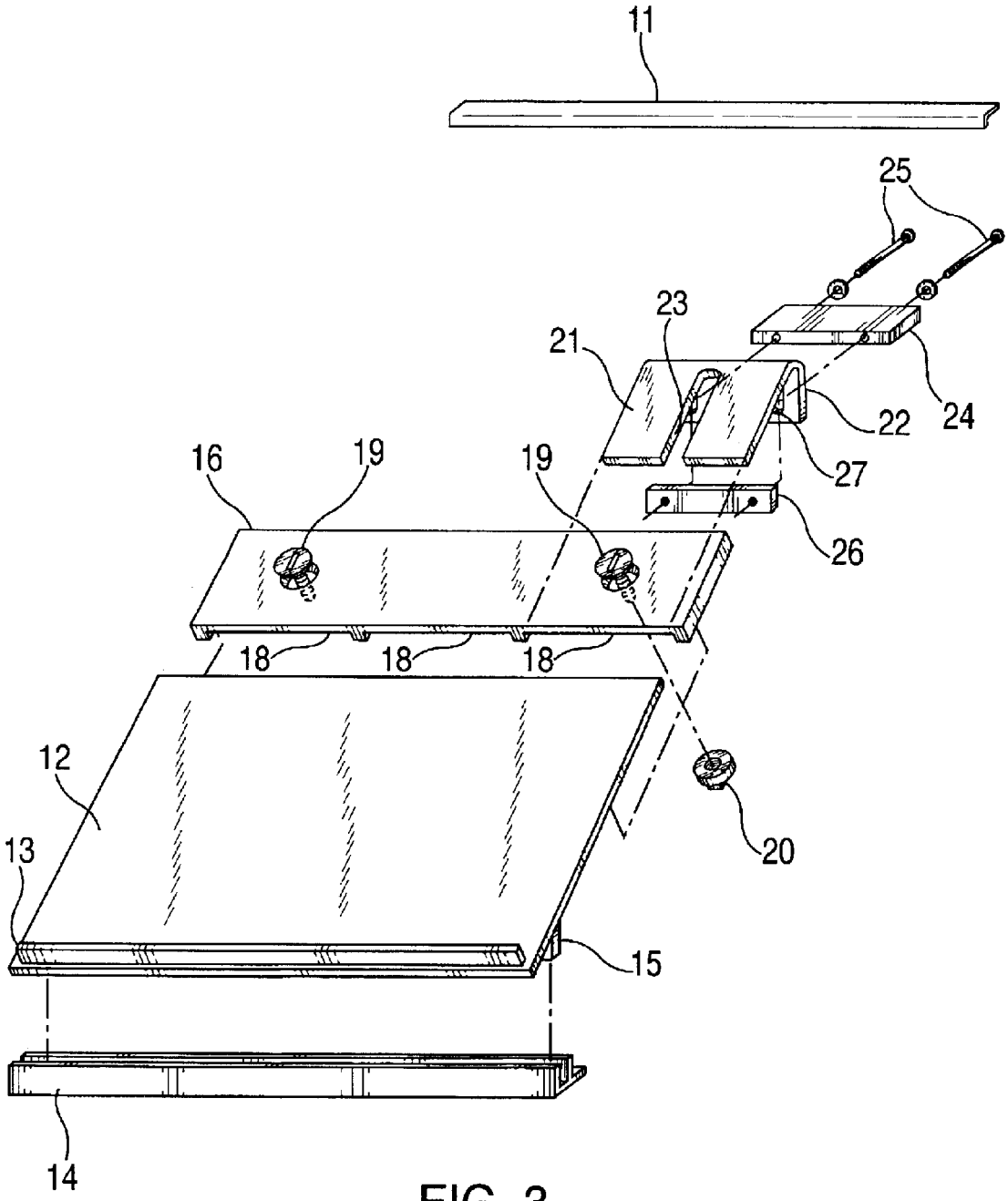
FIG. 3 is a perspective exploded view of all of the detailed parts of the invention.
Figure 4A:
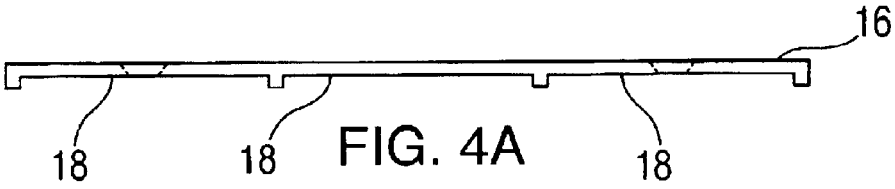
FIG. 4A is a front elevational view of a guide plate.
Figure 4B:
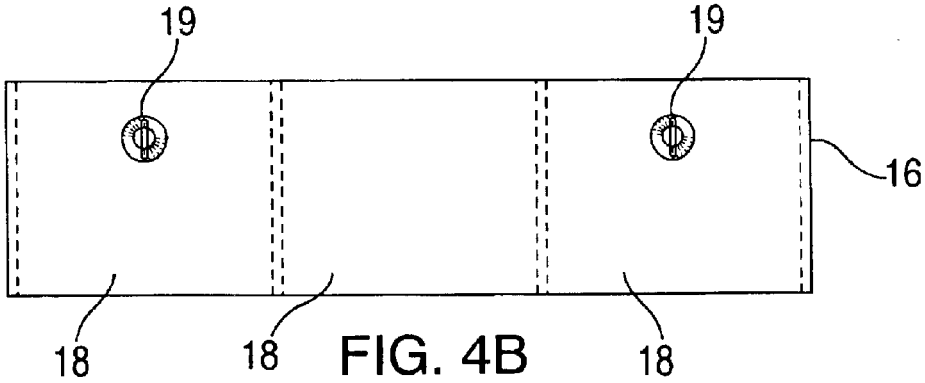
FIG. 4B is a top plan view of the guide plate shown in FIG. 4A
Figure 4C:
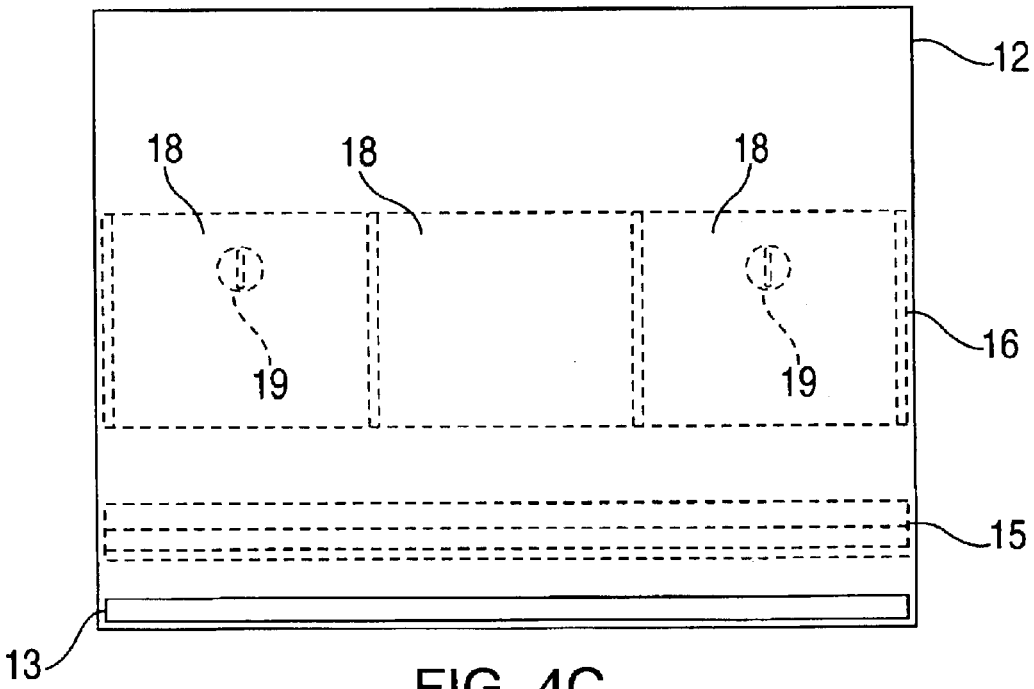
FIG. 4C is a top plan view of the hardboard top of the invention with the guide plate positioned underneath and shown in phantom. Also shown in phantom lines at the lower edge of the figure is the rail member which slidably engages a rail guide mounted on a keyboard shelf.
Figure 4D:
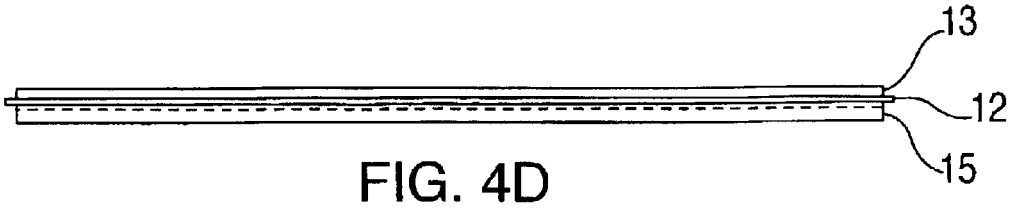
FIG. 4D is a front elevational view of work top which forms the subject matter of the invention and which shows a lip, hardboard top, and rail.
Figure 5:
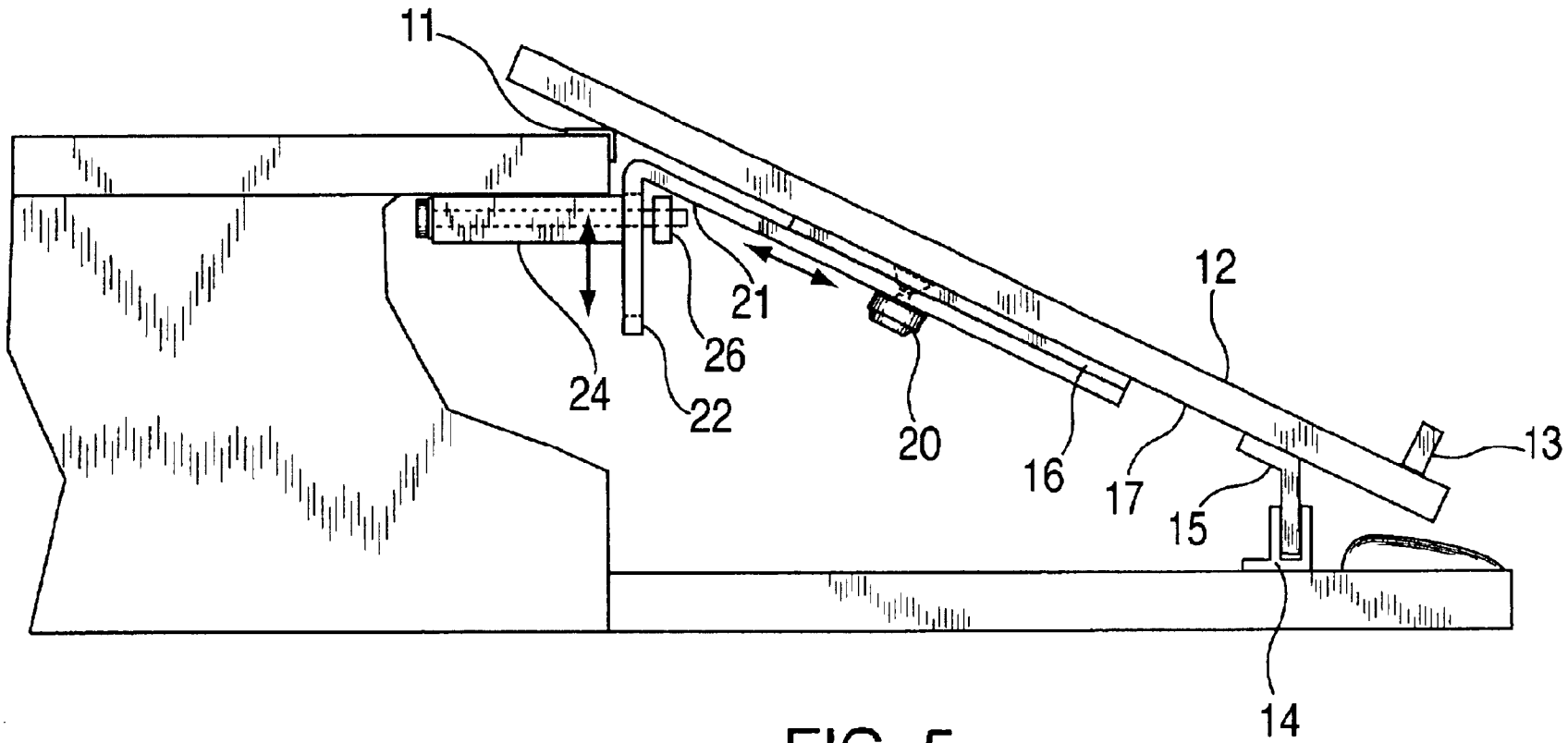
FIG. 5 is a side elevational view of the invention mounted on a work station wherein such work station is partially cutaway on the left to disclose the means by which the invention is attached to it.
Figure 6:
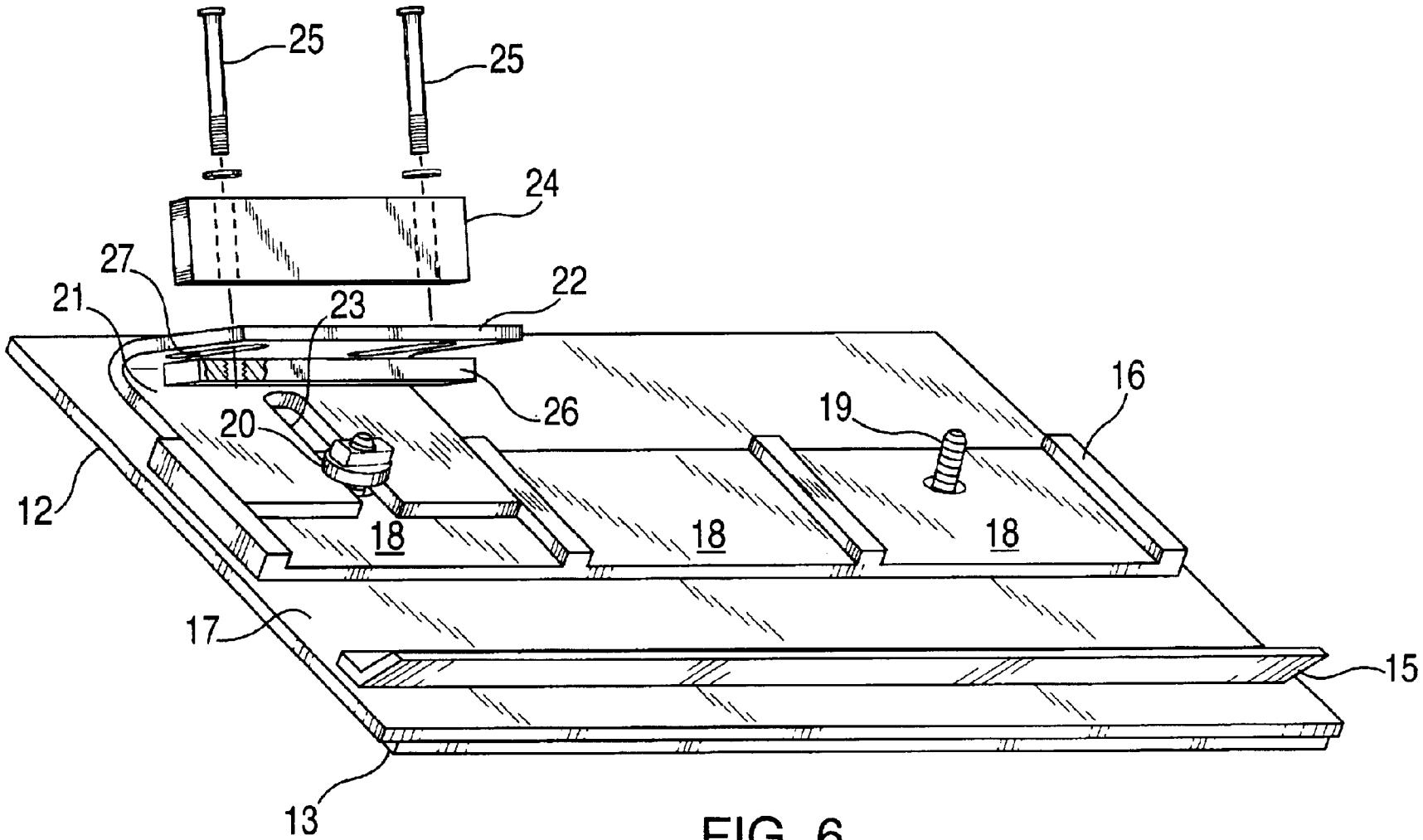
FIG. 6 is a perspective view of the underside of the invention, clearly disclosing the elements of the invention in their assembled condition but not mounted on a desk or computer cart.

A second adjustment plate 24 is also readily seen in FIG. 3, 5, and 6.

This second adjustment plate 24 adjusts the invention to the computer furniture cart top thickness. The second adjustment plate 24, as best seen in FIGS. 3 and 5, is at, preferably, a right angle to adjustment plate 21. A plurality of fastening devices such as screws 25 extend through second adjustment plate 24 and through openings 27 in adjustment plate 21 as best seen in FIGS. 3 and 5. A backing plate 26, having a plurality of threaded tapped holes, shown in FIGS. 3, 5, and 6, threadibly receive screws 25 which extend through the second adjustment plate 24, and adjustment plate 21 to provide for securing second adjustment plate 24 permanently in place. It should be clear from FIGS. 3, 5, and 6, that the angled portion 22 of adjustment plate 21 is sandwiched between second adjustment plate 24 and backing plate 26.

This adjustment plate 24, when slidable work top 12 is moved to the left as described above, its left edge will cooperate with the left vertical side of the computer cart or furniture which acts as a stop. Further with the work top in the left hand position, the upper surface of second adjustment plate 24 will contact or will cooperate with an underside of the computer cart 10 and the rail member 15, in guide 14, will project off the keyboard shelf as seen in FIG. 1.

It should be obvious that two such slidable work tops may be installed on one piece of computer furniture wherein one may be moved to the left and the other to the right. Thus, the computer operator may have an item on each of the two separate work tops at the same time. Still further, with two such slidable work tops installed and both are moved toward the middle over the keyboard, the work tops function as a cover for the keyboard. This will allow the keyboard shelf to remain pulled out.

OPERATION OF THE INVENTION

What has been described is a work top to be used in conjunction with a piece of computer furniture which has provisions for a computer keyboard shelf. The work top is adjustable to fit varying thicknesses of such computer cart or desk top and is further adjustable to such computer keyboard shelves that may be pulled out at different distances. Once the two adjustment plates are placed in their desired position and then fastened with the fasteners described, the work top may be installed or may be removed by simply placing it on to the pulled out keyboard shelf and by lifting it off the keyboard shelf. The shelf is adjustable to both fit varying thicknesses of the tops of computer furniture and to accommodate the distance that a keyboard shelf may be pulled out of the furniture. Again, this is accomplished by movement and securing of the first and second adjustment plates.

Though the invention has been described and illustrated with reference to a preferred embodiment, those skilled in the art will appreciate that various changes in modification in the shape, size, composition and arrangements of parts, may be resorted to without departing from the spirit of the invention or scope of the subjoined claims.

What is claimed:

1. A piece of computer furniture having a slide-out keyboard shelf and having a slidable work top which is adjustable to accommodate varying thicknesses of such computer furniture and is adjustable to accommodate varying distances to which the keyboard shelf may be pulled out of said computer furniture comprising:

(a) a slidable work top;

(b) a guide fastened to said slide-out keyboard shelf for slidably receiving said work top;

(c) a rail member disposed on the under surface of said slidable work top near its forward edge for slidably engaging said guide, whereby said work top can be moved relative to said keyboard side to side;

(d) a guide plate affixed to the undersurface of said slidable work top;

(e) an adjustable plate cooperating with said guide plate, said adjustable plate having an angled vertical member; and (f) a slot formed in said adjustable plate for slidably receiving screws disposed in said guide plate to allow said adjustment plate to move fore and aft relative to said keyboard.

2. The invention of claim 1 further comprising a second adjustment plate, at right angles to said adjustment plate, and attached thereto by a fastening device which extends there through said adjustment plate.

3. The invention of claim 2 further comprising a backing plate having a plurality of threaded tapped holes for receiving said fastening device, whereby said angled vertical member of said adjustment plate is sandwiched between said second adjustment plate and said backing plate whereby said adjustment plate may move fore and aft in said guide plate, relative to said computer keyboard shelf to adjust for keyboard shelves that may be pulled out at varying distances, such that said slidable work top may be moved side to side by a computer operator and may be adjusted to allow for the distance the keyboard shelf is pulled out and further, to allow for the thickness of said computer furniture top.

4. The invention of claim 3 wherein said guide plate comprises a plurality of sections affixed to an under surface of said slidable work top by attachment means.

5. The invention of claim 4 wherein one or more countersunk screws are disposed, flush, in said guide plate, and wherein an adjustment knob threads onto such countersunk screws to secure said adjustment plate to said guide plate.

6. The invention of claim 5 wherein said adjustment plate may move fore and aft in said guide plate by means of a slot formed in said adjustment plate for the passing through of said countersunk screws extending from said guide plate.

7. The invention of claim 6 wherein said second adjustment plate is at a right angle to the adjustment plate to adjust the slidable work surface to the computer furniture top thickness.

8. The invention of claim 7 wherein said plurality of fastening devices extend through said second adjustment plate and through openings in said adjustment plate.

9. The invention of claim 8 wherein said adjustment plate, when said slidable work top surface is moved to the left its left edge will cooperate with the left vertical side of said computer furniture which acts as a stop for the slidable work top.

* * * * *